US005587027A

United States Patent [19]

Tosaka et al.

[11] Patent Number: 5,587,027

[45] Date of Patent: Dec. 24, 1996

[54] METHOD OF MANUFACTURING CANNING STEEL SHEET WITH NON-AGING PROPERTY AND SUPERIOR WORKABILITY

[75] Inventors: Akio Tosaka; Chikako Fujinaga; Toshiyuki Kato; Kaku Sato; Hideo Kuguminato, all of Chiba, Japan

[73] Assignee: Kawasaki Steel Corporation, Kyogo, Japan

[21] Appl. No.: 389,045

[22] Filed: Feb. 15, 1995

[30] Foreign Application Priority Data

Feb. 17, 1994 [JP] Japan ..... 6-020346

[51] Int. Cl.[6] ..... C22C 38/06; C21D 8/00

[52] U.S. Cl. ..... 148/320; 148/603; 148/634; 148/651; 148/661

[58] Field of Search ..... 148/603, 634, 148/651, 661, 320

[56] References Cited

FOREIGN PATENT DOCUMENTS

| | | | |
|---|---|---|---|
| 0565066 | 10/1993 | European Pat. Off. . | |
| 0612857 | 8/1994 | European Pat. Off. . | |
| 50-31531 | 3/1975 | Japan . | |
| 2-197523 | 8/1990 | Japan . | |
| 2-303603 | 12/1990 | Japan . | |
| 405117757 | 5/1993 | Japan | 148/603 |
| 405222460 | 8/1993 | Japan | 148/603 |
| 6-116634 | 4/1994 | Japan . | |
| 022282421 | 11/1994 | Japan . | |
| 1117322 | 6/1968 | United Kingdom . | |

*Primary Examiner*—Deborah Yee
*Attorney, Agent, or Firm*—Oliff & Berridge

[57] ABSTRACT

A method for manufacturing a canning steel sheet with non-aging property and superior workability uses, as a starting material, an ultra-low-carbon steel slab composed of from 0.0015% to 0.0100% by weight C, up to 0.20% by weight Si, from 0.10% to 1.20% by weight Mn, from 0.02% to 0.10% by weight Al, from 0.005% to 0.040% by weight P, up to 0.015% by weight S, up to 0.005% by weight N, and balance iron and unavoidable impurities. The manufacturing method includes hot rolling the steel, cold rolling the steel at a reduction ratio not less than 70% after pickling, and recrystallization annealing the steel by using a continuous annealing furnace in an atmosphere having a hydrogen content not less than 3% and a dew point not lower than −20° C. at a temperature not lower than 730° C. so that the content of remained C in the steel is kept less than 0.0015% by weight. At least one element selected from Nb, Ti and B may be added in predetermined amounts to the above composition. The steel sheet suitable for canning is efficiently manufactured by a continuous annealing process.

21 Claims, 1 Drawing Sheet

FIGURE
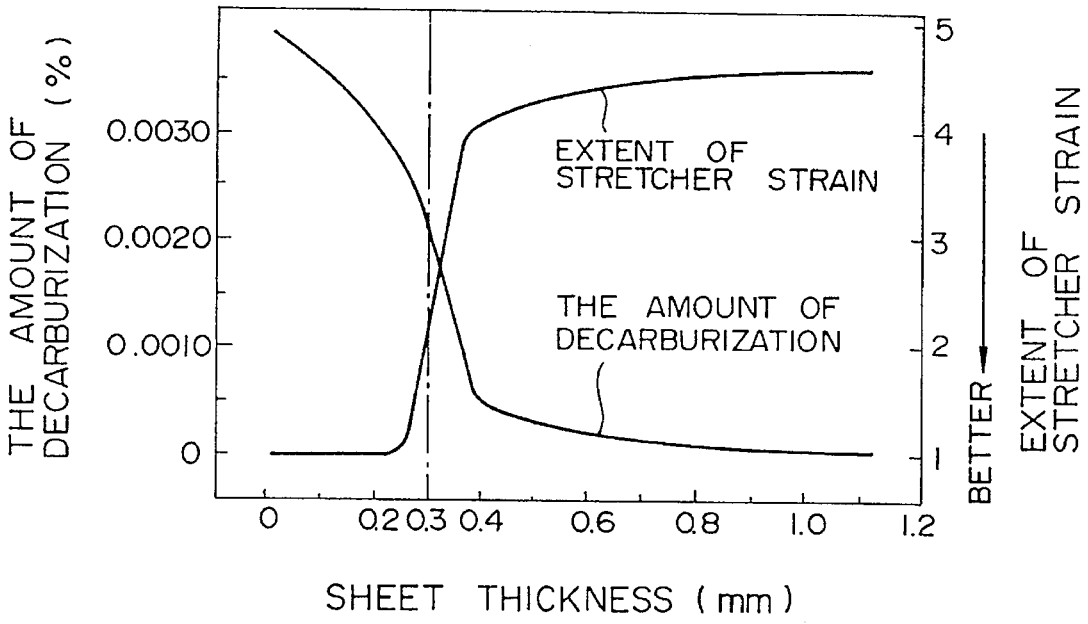

METHOD OF MANUFACTURING CANNING STEEL SHEET WITH NON-AGING PROPERTY AND SUPERIOR WORKABILITY

BACKGROUND OF THE INVENTION

The present invention relates to a manufacturing method for producing a thin steel sheet, particularly for use in canning. More particularly, the present invention provides an efficient manufacturing method for producing a canning steel sheet having very superior workability and superior non-aging property.

DESCRIPTION OF THE RELATED ART

Steel sheets for canning are usually painted before being fabricated into cans. In this process, if an excessive amount of solid-solution carbon (solid-solution C) is present in the steel sheet, the solid-solution C acts to fix mobile dislocation. Therefore, when such a canning steel sheet is drawn, not only are stretcher strains produced that may cause appearance failure, but also the elongation of the steel sheet is so reduced as to cause breakage, and/or the yield point is so raised as to cause a shape failure.

Further, even with light mechanical working such as bending, there may occur such phenomena in the steel as buckling, wrinkles and an appearance failure called fluting. A shape failure due to an excessive amount of spring-back resulting from the raised yield point may also occur.

To solve the above problems, a steel sheet with non-aging property and superior workability has been developed.

For example, there is known a method with which the content of solid-solution C in a steel may be reduced. The method uses a low-carbon, aluminum-killed steel as a starting material and subjects the steel to box annealing (i.e., batch annealing) that has a low cooling speed. However, the known manufacturing method is inefficient and has disadvantages such as inferior surface nature and inferior sheet shape, both induced from the process itself. Additionally, the steel sheet manufactured by the above-described method usually has an average Lankford value (hereinafter referred to as an r-value) in the range of 1.3 to 1.4. Considering a recent demand for reduction in the thickness of canning steel sheets, a steel sheet having an r-value in the order of 1.3 to 1.4 cannot be said to have a sufficient degree of workability.

Meanwhile, it has also been attempted to manufacture a steel sheet with non-aging property and superior workability by using an ultra-low-carbon steel as a starting material and subjecting it to continuous annealing.

For example, Japanese Patent Publication No. 50-31531 proposes a method wherein carbide- and nitride-producing components such as Ti and Nb or Zr and Ta are added in amounts stoichiometrically larger than the total content of C and N in the steel so that solid-solution C and N are fixed and stabilized in the form of compounds.

Of those components, however, Ti, Zr and Ta, in particular, are extremely chemically active and tend to deteriorate sheet surface nature. Hence, the manufactured steel sheet is not suitable for canning steel sheets that require corrosion resistance and visual fineness. Adding Nb in a large amount also produces large fluctuations in material properties of the steel sheet in both the widthwise and lengthwise directions. Further, the recrystallizing temperature is so greatly raised as to cause trouble in annealing. Moreover, those components are generally expensive and addition thereof in large amounts leads to an increased cost of the alloy components.

Another conceivable solution is a method of reducing the content of C in a steel sheet to a large extent. For example, a steel-making process may be controlled so that the total content of solid-solution C and N are each not larger than 0.0010% by weight. However, to produce such a high-purity steel on an industrial basis is not easy even with today's steel-making technology. One of the major factors impeding this process is particularly that the phenomenon of the steel absorbing C from surrounding materials during a solidifying process in continuous casting cannot be controlled. Even if an ultra-high-purity steel meeting the above conditions could be produced, the following problems would still exist:

a) The transformation point is greatly raised, making it difficult to manufacture a hot-rolled coil having uniform structure, by the hot rolling step.

b) The steel tends to recrystallize very easily and results in grain growth, and hence the structure becomes coarser. This results in a risk that, in the drawing step or the like, a so-called rough surface results and the appearance of the steel sheet is marred.

c) The content of solid-solution C and N of about 0.0010% by weight in the manufacturing stage, including hot rolling, represents a region where material properties are subject to relatively great fluctuations. Thus, even slight component fluctuations on the order of 2 to 3 ppm give rise to undesired gross fluctuations in the material properties.

SUMMARY OF THE INVENTION

An object of the present invention is to effectively solve the problems explained above. The present invention thus provides a method of manufacturing a thin steel sheet for canning, which has non-aging property and superior workability, by an efficient continuous annealing process. The manufacturing method satisfies the demanded characteristics for canning steel sheet such as superior economy, workability (mechanical characteristics) and plating property.

With the view of developing a steel sheet for canning, which has non-aging property and superior workability, the inventors have developed a continuous annealing process having high productivity on an industrial basis. The inventors have found a method capable of stably manufacturing a steel sheet that satisfies the demanded characteristics. The process is the result of fabricating steels consisting of various components under various manufacturing conditions and studying their suitability as a steel sheet for canning.

More specifically, the gist of the present invention is as follows.

A manufacturing method for a canning steel sheet with non-aging property and superior workability comprises the steps of:

(a) using, as a starting material, an ultra-low-carbon steel slab having the following composition:
C: from 0.0015% to 0.0100% by weight,
Si: up to 0.20% by weight,
Mn: from 0.10% to 1.20% by weight,
Al: from 0.02% to 0.10% by weight,
P: from 0.005% to 0.040% by weight,
S: up to 0.015% by weight,
N: up to 0.005% by weight, and balance iron and unavoidable impurities;

(b) hot rolling the steel;

(c) cold rolling the steel at a draft ratio of at least 70% after pickling; and (d) recrystallization annealing the steel by using a continuous annealing furnace in an atmosphere having a hydrogen content of at least 3% and a dew point of at least −20° C. at a temperature of at least 730° C. so that the content of remained C in the steel is kept less than 0.0015% by weight.

Another manufacturing method for a canning steel sheet with non-aging property and superior workability is also provided wherein the steel further includes, in addition to the above composition, at least one element selected from the group consisting of:

Nb: from 0.003% to 0.015% by weight,

Ti: from 0.003% to 0.040% by weight, and

B: from 0.0005% to 0.0020% by weight.

Other features of the present invention will be apparent from the following detailed description and the claims.

BRIEF DESCRIPTION OF THE DRAWING

FIGURE is a graph showing the relationships between a sheet thickness and an amount of decarburization and mechanical property for a steel sheet subject to continuous annealing after cold rolling.

DETAILED DESCRIPTION OF PREFERRED EMBODIMENTS

In the present invention, the content of C finally remaining in the steel is held to be less than 0.0015% by weight for the purpose of improving workability and non-aging property of the steel. To avoid a difficulty encountered in the manufacturing steps, however, the content of C during the slab stage and the hot rolling stage may fall in the range of from 0.0015% to 0.0100% by weight, which is relatively easy to achieve. Then, during the final annealing stage, the content of C is controlled to be less than 0.0015% by utilizing a decarburization reaction. To achieve such control of material properties on an industrial level, it is important to adjust the content of other alloy components, including Nb. It is also important to control the annealing conditions, particularly the annealing temperature and annealing atmosphere.

A description will first be made of reasons for limiting the content of chemical components in a steel slab material.

C: 0.0015% to 0.0100% by weight:

From the standpoints of elongation and the average r-value, the content of C in the steel is desirably as low as possible. However, if the content of C during the slab stage is less than 0.0015% by weight, the grain size would be so remarkably increased as to incur a highly possible risk that "orange peel" like surface defects may occur. Troubles may also arise in the state of a product during the final stage after mechanical working. Further, the transformation point, which is greatly affected by the content of C in the steel, would be raised to a large extent. Therefore, finish rolling could not be completed in an austenite single-phase region, and the composition would be unsuitable as material for a steel sheet that must be homogeneous and exhibit superior workability. On the other hand, if the content of C exceeds 0.0100%, the decarburization reaction could not be sufficiently achieved by annealing for a short period of time after cold rolling, and the intended non-aging property could not be obtained.

In the case of actual production on an industrial basis, the amount of decarburization is limited because the length of a production line is restricted and the annealing time cannot be set to be too long. For that reason, the content of C is desirably not larger than 0.0050%. This range is also preferable particularly from the standpoint of improving the average r-value of the steel. Accordingly, the content of C in the steel slab used as the starting material is set to be from 0.0015% to 0.0100% by weight, preferably from 0.0015% to 0.0050% by weight.

Si: up to 0.20% by weight:

So as to expedite the decarburization reaction, Si is a component desired to be added in an amount of as large as possible. However, an upper limit on the amount of Si added is set because an excessive amount of Si gives rise to a problem in surface treatment. Also, since Si acts to raise the transformation point of steel, a lower content of Si contributes to alleviating restrictions on the finish rolling conditions during the hot-rolling stage. Accordingly, an upper limit on the content of Si is 0.20% by weight. This limitation avoids the creating of surface treatment problems caused when the composition is used for a steel sheet subject to surface treatment, including a steel sheet for canning. Preferably, the content of Si is not larger than 0.10% by weight.

Mn: 0.10% to 1.20% by weight:

Mn is contained in the steel corresponding to the content of S. Mn is present to prevent hot shortness of the steel, and requires at least 0.10% by weight or more. Addition of Mn lowers the transformation point and hence is advantageous in alleviating the restrictions on finish rolling conditions during the hot-rolling stage.

Also, by selecting the proper content of Mn, it is possible to controllably intensify the solid-solution in the steel sheet, and to make the sheet structure more homogeneous and finer. It was found, however, that if the content of Mn exceeds 1.20 % by weight, the decarburization reaction during continuous annealing intended by the present invention would be retarded. The detailed mechanism of this aspect is not clear. Accordingly, the content of Mn is set to be from 0.10% to 1.20% by weight. By preferably setting the Mn content to be less than 0.50% by weight, the decarburization step can be performed with higher efficiency, which results in better workability of the steel.

Al: 0.02% to 0.10% by weight:

Al is an important component for fixing and stabilizing N in the steel. In the present invention, N is required to be contained in the steel in an amount of not less than 0.02% by weight from the standpoint of reducing the non-aging property of the steel. However, if Al is contained in excess of 0.10% by weight, not only is the component cost increased, but also a risk of causing surface defects is increased. A risk of causing fractures during the steel slab stage would also be increased.

Accordingly, the content of Al is set to be from 0.02% to 0.10% by weight. To stably prevent fractures of the slab, the content of Al is preferably set to be not larger than 0.04% by weight.

P: 0.005% to 0.040% by weight:

P has a great ability of intensifying a solid-solution in the steel sheet, similar to Si. P is thus a component desired to be added in an amount as large as possible when a hard steel sheet for canning is manufactured. However, an excessive content of P is undesired because problems of deterioration in corrosion resistance and embrittlement of the material would become remarkable, and the recrystallizing temperature would be raised. The effect of intensifying a solid-solution due to addition of P appears to exist at a P content of not less than 0.005% by weight, and the above problems begin to occur when the P content is in excess of 0.040% by weight.

Accordingly, the content of P is set to be from 0.005% by weight to 0.040% by weight. To obtain better corrosion resistance and higher workability, the content of P is preferably set to be not larger than 0.010% by weight.

S: up to 0.015% by weight:

S is a component desired to be removed from the steel in the present invention. Reducing the content of S diminishes precipitates in the steel and improves workability. Although the detailed mechanism is not clear, reducing the content of S is also advantageous in expediting the decarburization reaction during the continuous annealing step, which is an object of the present invention. Such an effect is obtained when the content of S is less than 0.015% by weight, but the S content of less than 0.007% by weight is desirable. Accordingly, the content of S is set to be less than 0.015% by weight, preferably less than 0.007% by weight.

N: up to 0.005% by weight:

An upper limit for the content of N is specified from the standpoint of reduction in the non-aging property of the steel. More specifically, if a relatively large amount of N is contained in the steel, the effect of fixing and stabilizing N by added Al would not sufficiently develop and solid-solution N exceeding its critical amount would remain in the final product. This would lead to the occurrence of fluting in manufacture of three-piece cans, for example, and of stretcher strains during light mechanical working of the steel. Also, when the content of N in the steel is relatively large, it is advantageous to correspondingly increase the amount of Al added to avoid reduction in the non-aging property. However, if the content of N exceeds 0.005% by weight, not only would ductility be remarkably deteriorated, but also a risk of causing fractures in the steel slab manufacturing stage would be increased. Accordingly, the content of N is set to be up to 0.005% by weight. To further improve workability represented by the average r-value, etc., the content of N is preferably set to be up to 0.003% by weight.

Nb: 0.003% to 0.015%; Ti: 0.003% to 0.040%; B: 0.0005% to 0.0020% by weight:

Nb, Ti and B are components effective to improve the non-aging property and weldability and to prevent the occurrence of rough surfaces of steel. Although the detailed mechanism is not clear, the non-aging property of the steel sheet can be stably controlled even with the content of C being in an ultra low range, as in the present invention, by selecting the contents of Nb and Ti to be not less than 0.003% by weight and the content of B to be not less than 0.0005% by weight. In other words, superior non-aging property, which is not obtainable just by simply reducing the content of C down to not larger than 0.0010% by weight, can be obtained. Addition of those elements is also effective to improve planar anisotropy of the steel sheet, and to enhance weldability even with such small contents. Moreover, those elements are effective to reduce the size of crystal grains. This means that addition of those elements is further desirable from the standpoint of, e.g., preventing the occurrence of rough surfaces during the shaping step.

More particularly, in the present invention, there is a fear that the crystal grain size may be increased during the manufacturing steps because the content of C in the material is low. If the increased grain size is brought into the final product, there would be a high risk of causing rough surfaces. Thus, addition of the above three elements provides a very important effect in preventing increased surface roughness.

On the other hand, if the contents of Nb, Ti and B exceed respectively 0.015%, 0.040% and 0.0020% by weight, respectively, the recrystallizing temperature would be so raised as to pose a difficulty in the annealing step after cold rolling. Such excessive addition would also obstruct the decarburization reaction during the continuous annealing step that is essential in the present invention. Moreover, an increase in the alloy component cost is another problem that must be taken into consideration. Accordingly, the content of Nb is set to be from 0.003% by weight to 0.015% by weight; the content of Ti is set to be from 0.003% by weight to 0.040% by weight; and the content of B is set to be from 0.0005% by weight to 0.0020% by weight.

In the case where it is important to give improved ductility to the steel sheet, it is desirable to set an upper limit of the content of Nb to be 0.010% by weight, an upper limit of the content of Ti to be 0.020% by weight, and an upper limit of the content of B to be 0.0010% by weight.

A manufacturing method will now be described.

While manufacturing conditions for hot rolling are not especially restricted, the manufacturing method for steel sheet of the present invention is desirably carried out as follows.

The finish rolling temperature is required to be not lower than the $Ar_3$ transformation temperature, at which transformation from austenite to ferrite starts in the cooling process, for obtaining good workability that is represented by the average r-value after cold rolling and annealing. However, if the finish rolling temperature exceeds 1000° C., the steel sheet would be apt to have a grosser structure and would tend to have deteriorated workability. Therefore, the finish rolling temperature is desirably not lower than the $Ar_3$ transformation temperature and not higher than 1000° C. However, it is noted that depending on specific applications, it is allowed to lower the finish rolling temperature to about ($Ar_3$–50° C.).

The cooling rate from the end of hot rolling to the start of coiling is preferably not less than 30° C./s. By so selecting the cooling rate, the steel sheet can have the desired finer structure, and hence the final product exhibits good workability.

After the end of hot rolling, it is advantageous to start cooling the steel as early as possible. This cooling helps to provide the finer structure of the steel sheet. The cooling is desirably started within about 0.3 sec.

The coiling temperature is desirably between 450° C. and 680° C. If the coiling temperature is lower than 450° C. the cooling would be so uneven as to disorder the sheet shape, thereby impeding subsequent steps of pickling and cold rolling. On the other hand, if the coiling temperature exceeds 680° C., the time required for pickling would be prolonged because of an increase in the scale thickness, and workability of the final steel sheet would be poor as a result of the basic material having the grosser structure. Also, a coiling temperature higher than 680° C. is unwanted from the fact that fluctuations in material properties in the widthwise direction of the steel sheet would result due to differences in the cooling rate after coiling.

Reasons for restricting the manufacturing method of the present invention will be described below.

Cold rolling reduction ratio: not less than 70%:

The cold rolling reduction ratio after pickling is set to be not less than 70%. A lower limit for the reduction ratio is set to be 70% because deep drawing could not be sufficiently applied if it is less than 70%. Preferably, the desirable reduction ratio is not less than 80%. Although the detailed mechanism is not clear, the decarburization reaction during the continuous annealing step tends to accelerate by setting the cold rolling reduction ratio to be not less than 70%.

Annealing temperature: not lower than 730° C.:

The annealing temperature is specified based on the consideration that 730° C. represents the lowest temperature at which recrystallization is completed and the temperature at which the decarburization reaction becomes remarkable. While an upper limit for the annealing temperature is not particularly specified, this upper limit corresponds to an upper limit temperature in actual operation at which there will not occur such defects as sheet breakage and heat buckling during the continuous annealing step. If the process is free from the above problems, the upper limit for the annealing temperature is provided by the highest temperature at which austenite appears as a steel phase.

To stabilize material properties, annealing is desirably carried out for 20 sec or more by soaking. With soaking for 20 sec or more, decarburization of the steel sheet, essential in the present invention, is sufficiently achieved.

Annealing atmosphere: hydrogen content not less than 3%; dew point not lower than −20° C.:

The annealing atmosphere is the most important factor in the present invention, and is established by setting the hydrogen content to be not less than 3% and the dew point to be not lower than −20° C. By so keeping the dew point at a higher level, the decarburization reaction can be developed by soaking for a short time. A remarkable improvement in material properties of the steel (particularly non-aging property) due to decarburization is achieved only with a combination of the annealing temperature set to be not lower than 730° C. and the ultra-low-carbon steel subject to a strain at the high cold rolling reduction ratio.

Upper limits of the hydrogen content and the dew point are not particularly specified, but are preferably set as follows. If the hydrogen content exceeds 10%, a high danger would result and the effect of hydrogen would approach a saturated state, thereby increasing production cost. Therefore, the hydrogen content is preferably not larger than 10%. If the dew point exceeds 0° C., oxidation of the sheet surface and surface concentration of impurity elements would be remarkable, and a further pickling process would be required again in the later step.

A description will now be made of reasons for limiting the content of C remained in the steel obtained by decarburization made in a continuous annealing furnace as described above. The sheet thickness during the continuous annealing step after cold rolling will also be described.

Content of Remained C: less than 0.0015% by weight:

If the content of remained C is not reduced down to less than 0.0015% by weight, such defects as fluting and stretcher strains would be caused when applied to a steel sheet for canning. For application areas that require particularly strict quality, the content of remained C is desirably not larger than 0.0010% by weight.

Sheet thickness during continuous annealing step after cold rolling: not larger than 0.30 mm:

The sheet thickness during the continuous annealing step after cold rolling is set to be not larger than 0.30 mm. It is thought that since the decarburization reaction during the continuous annealing step in the present invention accompanies the so-called interfacial reaction, the ratio of surface area to total volume of the steel sheet is increased as the sheet thickness is reduced. Also, the influence of decarburization upon mechanical properties becomes more remarkable.

FIGURE is a graph showing the relationships between a thickness (mm) of the steel sheet and an amount of decarburization and stretcher strains. The steel composition depicted in the graph is one having 0.0040% by weight C, with other components falling within respective ranges of the present invention. The steel undergoes normal hot rolling and pickling. The steel is then subjected to cold rolling at a reduction ratio of 75% while changing the sheet thickness to various values. The steel sheet is then subjected to recrystallization annealing in an atmosphere having a hydrogen content of 3% and a dew point of −7° C. at a soaking temperature of 750° C. for the soaking time of 50 sec. Here, the stretcher strains are determined by visually evaluating an appearance of each steel sheet in five ranks after slight stretch forming thereof.

As seen from FIGURE, under the same annealing conditions, when the sheet thickness exceeds 0.30 mm, the amount of decarburization is abruptly reduced, and correspondingly, the stretcher strains are increased to a large extent. For this reason, the steel thickness during the continuous annealing step after cold rolling is limited to not larger than 0.30 mm in the present invention.

Additionally, in the case of manufacturing a soft temper plating base sheet, it is preferable to apply temper rolling under light reduction at a reduction ratio of less than 2% after the above annealing.

Also, in the case of manufacturing a hard temper plating base sheet from the steel sheet having been subjected to the above annealing, the so-called secondary rolling is performed at a reduction ratio of 2 to 40%. The reason for setting an upper limit for the reduction ratio to 40% is that, if a reduction ratio higher than such an upper limit is set in usual cold rolling, the steel sheet would be very remarkably disordered in its shape.

EXAMPLES

Example 1

Slabs produced by melting steels, which had component compositions shown in Table 1, by an actual converter and continuously casting them were reheated to 1250° C. The steels were then subject to finish rolling in the temperature range of 880° to 950° C. while making adjustments in accordance with the respective steel compositions so that finish rolling temperatures were kept not lower than the $Ar_3$ transformation temperature.

After the hot rolling step, hot-rolled sheets were cooled at the cooling rate of 40° C./s, coiled at the coiling temperature of 620° C. and, after pickling, subject to cold rolling at a reduction ratio of 88%, thereby obtaining cold-rolled steel sheets each having a thickness of 0.25 mm.

These steel sheets were annealed by using a continuous annealing furnace at the soaking temperature of 780° C. and the soaking time of 30 sec. On this occasion, the furnace was filled with an atmosphere having a hydrogen content of 3% (the balance being essentially $N_2$) and a dew point of −15° C. The cooling rate after the annealing was set to a constant value of 25° C./s. The content of remained C was assayed for each of the steel sheets thus fabricated. The steel sheets were subject to temper rolling at a constant reduction ratio of 1.0%. Thereafter, the steel sheets were subject to continuous #25 tin plating through an electric tin plating line of halogen type to form tin-plated sheets. Tensile characteristics were then assayed for each of the tin-plated sheets.

The assay results are shown in Table 2. Note that tensile characteristics were assayed by using a JIS No. 5 test sample, as usually employed.

TABLE 1

(unit: % by weight)

| Steel | C | Si | Mn | Al | P | S | N | Nb | Ti | B | Remarks |
|---|---|---|---|---|---|---|---|---|---|---|---|
| 1 | 0.0025 | 0.02 | 0.25 | 0.045 | 0.007 | 0.008 | 0.0035 | — | — | — | Inventive |
| 2 | 0.0045 | 0.05 | 0.15 | 0.030 | 0.010 | 0.004 | 0.0025 | — | — | — | Examples |
| 3 | 0.0045 | 0.07 | 0.55 | 0.035 | 0.007 | 0.006 | 0.0015 | — | — | — | |
| 4 | 0.0025 | 0.01 | 0.15 | 0.045 | 0.005 | 0.004 | 0.0020 | 0.005 | — | — | |
| 5 | 0.0028 | 0.01 | 0.10 | 0.040 | 0.003 | 0.002 | 0.0015 | — | 0.009 | — | |
| 6 | 0.0030 | 0.03 | 0.15 | 0.040 | 0.003 | 0.002 | 0.0015 | 0.003 | 0.005 | 0.0010 | |
| 7 | 0.0150 | 0.11 | 0.20 | 0.015 | 0.005 | 0.003 | 0.0045 | — | — | — | Comparative |
| 8 | 0.0030 | 0.05 | 1.45 | 0.045 | 0.005 | 0.005 | 0.0034 | — | — | — | Examples |
| 9 | 0.0030 | 0.07 | 0.75 | 0.042 | 0.007 | 0.008 | 0.0070 | — | — | — | |
| 10 | 0.0025 | 0.10 | 0.15 | 0.045 | 0.010 | 0.004 | 0.0035 | 0.017 | — | — | |
| 11 | 0.0110 | 0.07 | 1.85 | 0.006 | 0.020 | 0.006 | 0.0040 | — | — | — | |

Note: Underlined values are outside of the ranges of the present invention.

TABLE 2

| Steel | Remained C after annealing (% by weight) | YS ($kg/mm^2$) | TS ($kg/mm^2$) | Total Elongation (%) | Average r-value | Δr-value ± | AI ($kg/mm^2$) | Yield Point Elongation after Aging (%) | Remarks |
|---|---|---|---|---|---|---|---|---|---|
| 1 | 0.0007 | 16 | 30 | 50 | 1.8 | 0.10 | 0 | 0 | Inventive |
| 2 | 0.0009 | 17 | 31 | 49 | 1.8 | 0.10 | 0 | 0 | Examples |
| 3 | 0.0010 | 18 | 31 | 49 | 1.7 | 0.10 | 0 | 0 | |
| 4 | 0.0008 | 16 | 31 | 50 | 1.8 | 0.05 | 0 | 0 | |
| 5 | 0.0012 | 16 | 30 | 50 | 1.9 | 0.05 | 0 | 0 | |
| 6 | 0.0007 | 16 | 30 | 50 | 1.9 | 0.05 | 0 | 0 | |
| 7 | 0.0140 | 27 | 37 | 33 | 1.0 | 0.45 | 5 | 4.0 | Comparative |
| 8 | 0.0028 | 22 | 33 | 38 | 1.1 | 0.40 | 4 | 3.0 | Examples |
| 9 | 0.0012 | 21 | 37 | 41 | 1.1 | 0.30 | 4 | 4.5 | |
| 10 | 0.0024 | 21 | 33 | 44 | 1.4 | 0.25 | 2.5 | 1.0 | |
| 11 | 0.0064 | 31 | 40 | 33 | 0.9 | 0.40 | 5 | 4.0 | |

The r-value was measured based on the three-point method by using a JIS No. 5 test sample. The r-value was calculated in terms of the average r-value=$(r_0+r_{90}+2r_{45})/4$ and $\Delta r=(r_0+r_{90}-2r_{45})/2$ where the r-values in directions of 0°, 45° and 90° with respect to the rolling direction are respectively $r_0$, $r_{45}$ and $r_{90}$.

Further, the aging index (AI) was evaluated by using a JIS No. 5 test sample as above, applying a pre-strain of 7.5%, releasing the load, and measuring an increase in stress after aging at 100° C. for 30 minutes.

From the above assay results, it is seen that, in the steels conforming to the present invention, the final content of remained C is less than the predetermined value of 15 ppm and decarburization is developed at a sufficient level. While the tensile strength TS is rather reduced, the total elongation exhibits very good values. Also, the average r-value is markedly high and the Δr value is small (i.e., planar anisotropy and earing are each small), thus ensuring superior workability. Particularly, AI and the yield point elongation after aging are zero for all of the steels conforming to the present invention, meaning that the non-aging property is remarkably improved.

The steel sheet having such a high average r-value and such a small Ar value is suitably fit for use in the field of two-piece cans which require not only ductility but also good earing characteristics. Further, the steels conforming to the present invention that have so improved non-aging property and superior ductility are soft and superior in secondary forming property even after strong mechanical working or a subsequent aging process. It is confirmed that the steel sheets of the present invention have characteristics of being hard to cause failures such as fractures, for example, when they are employed for DI cans and neck portions are flanged. It is also confirmed that the steels conforming to the present invention have corrosion resistance comparable to or superior to a conventional low-carbon, Al-killed steel in the usual corrosive environment.

It is further seen that the effects of Nb, Ti and B are particularly effective to prevent deterioration in the surface nature during mechanical working.

On the other hand, for the steels departing from the scope of the present invention, the elongation and the r-value both representing workability tend to deteriorate. This tendency is presumably mainly caused by the fact that decarburization is not sufficiently developed. Further, because of these factors having large measured values, which represent aging characteristics, stretcher strains were caused and a failure of appearance was found in a canning test conducted by using an actual canning machine.

Example 2

Slabs produced by melting steels, which had component compositions shown in Table 3, by an actual converter and continuously casting them were rolled into steel sheets under manufacturing conditions shown in Table 4. The steel slabs were then assayed for various characteristics as in Example 1.

The assay results are shown in Table 5.

TABLE 3

| C | Si | Mn | Nb | Al | P | S | N |
|---|---|---|---|---|---|---|---|
| 0.0028 | 0.02 | 0.45 | 0.0055 | 0.045 | 0.007 | 0.007 | 0.0028 |

1) unit: % by weight
2) added elements other than above: balance being essentially Fe

TABLE 4

| Material Symbol | Finishing Temperature (°C.) | Cooling Temperature (°C./s) | Coiling Temperature (°C.) | Cold Rolling Reduction Ratio (%) | Hydrogen Content (%) | Dew Point (°C.) | Annealing Temperature (°C.) | Annealing Time (s) | Remarks |
|---|---|---|---|---|---|---|---|---|---|
| a | 890 | 40 | 530 | 88 | 4 | −14 | 745 | 30 | Inventive |
| b | 910 | 55 | 600 | 90 | 5 | −12 | 755 | 25 | Examples |
| c | 910 | 40 | 530 | 65 | 4 | −12 | 745 | 30 | Comparative |
| d | 750 | 40 | 530 | 88 | ≦1 | −15 | 745 | 30 | Example |
| e | 890 | 40 | 530 | 88 | 4 | −50 | 745 | 30 | |
| f | 750 | 40 | 530 | 88 | 4 | −15 | 710 | 30 | |
| g | 890 | 40 | 530 | 88 | 4 | −15 | 745 | 10 | |

Note: Underlined values are outside of ranges of the present invention.

TABLE 5

| Material Symbol | Remained C after annealing (% by weight) | YS (kg/mm²) | TS (kg/mm²) | Total Elongation (%) | Average r-value | Δr-value ± | AI (kg/mm²) | Yield Point Elongation after Aging (%) | Remarks |
|---|---|---|---|---|---|---|---|---|---|
| a | 0.0009 | 16 | 31 | 48 | 1.9 | 0.10 | 0 | 0 | Inventive |
| b | 0.0008 | 15 | 30 | 50 | 1.8 | 0.10 | 0 | 0 | Examples |
| c | 0.0021 | 21 | 33 | 45 | 1.3 | 0.05 | 1.5 | 1.5 | Compar- |
| d | 0.0027 | 24 | 32 | 43 | 1.4 | 0.45 | 2.0 | 2.5 | ative |
| e | 0.0028 | 25 | 33 | 44 | 1.5 | 0.40 | 2.5 | 2.5 | Example |
| f | 0.0028 | 25 | 33 | 43 | 1.3 | 0.30 | 2.5 | 3.0 | |
| g | 0.0022 | 21 | 34 | 46 | 1.4 | 0.25 | 2.0 | 2.0 | |

From the above assay results, it is seen that the steel sheets fabricated by using the steels conforming to the present invention under the manufacture conditions within the scope of the present invention have superior characteristics in both forming property and non-aging property. These superior results are present because the decarburization reaction is sufficiently developed during the continuous annealing step. It is also confirmed that, by using the steels conforming to the present invention as material and subjecting them to secondary cold rolling at a reduction rate of 2 to 40%, hard temper plating base sheets corresponding to DR9 can be obtained. Also, the steels of the present invention possess non-aging property and superior forming property to conventional steels having the comparable strength.

On the other hand, for the steels departing from the scope of the present invention, the decarburization reaction is hard to develop. A result is that increasing surface roughness during press forming is found even when the content of remained C is finally less than 0.0015% by weight.

According to the present invention, a canning steel sheet with non-aging property and superior workability can be efficiently manufactured. The steel sheet is manufactured by limiting component composition of an ultra-low-carbon steel, specifying conditions for cold rolling and continuous annealing, and selecting the content of remained C after the annealing and the sheet thickness during the continuous annealing after the cold rolling.

The canning steel sheet manufactured by the present invention has very superior characteristics to conventional steel and can be advantageously employed for use with a variety of cans.

What is claimed is:

1. A method for manufacturing a canning steel sheet with non-aging property and superior workability, comprising the steps of:

(a) using, as a starting material, an ultra-low-carbon steel slab consisting essentially of:
C: from 0.0015% to 0.0100% by weight,
Si: up to 0.20% by weight,
Mn: from 0.10% to 1.20% by weight,
Al: from 0.02% to 0.10% by weight,
P: from 0.005% to 0.040% by weight,
S: up to 0.015% by weight,
N: up to 0.005% by weight, and balance iron and unavoidable impurities;

(b) hot rolling said steel;

(c) pickling said steel;

(d) cold rolling said steel at a reduction ratio of at least 70% after said pickling step; and (e) recrystallization annealing said steel in a continuous annealing furnace in an atmosphere having a hydrogen content of from 3% to less than 10% and a dew point not lower than −20° C. at a temperature not lower than 730° C. such that the content of remained C in said steel is kept less than 0.0015% by weight.

2. The method of claim 1, wherein said steel sheet has a thickness not larger than 0.3 mm after said cold rolling step.

3. The method of claim 1, further comprising secondary cold rolling said steel at a reduction ratio of from 2% to 40%.

4. The method of claim 1, wherein said carbon is present in said starting material in an amount less than 0.0050% by weight.

5. The method of claim 1, wherein said silicon is present in said starting material in an amount less than 0.10% by weight.

6. The method of claim 1, wherein said manganese is present in said starting material in an amount less than 0.50% by weight.

7. The method of claim 1, wherein said aluminum is present in said starting material in an amount less than 0.04% by weight.

8. The method of claim 1, wherein said phosphorus is present in said starting material in an amount less than 0.010% by weight.

9. The method of claim 1, wherein said sulfur is present in said starting material in an amount less than 0.007% by weight.

10. The method of claim 1, wherein said nitrogen is present in said starting material in an amount less than 0.003% by weight.

11. The method of claim 1, wherein said hot rolling step comprises finish rolling said steel at a temperature between the $Ar_3$ transformation temperature of the steel and 1000° C., cooling said steel at a rate of at least 30° C./sec, coiling said steel at a temperature between 450° C. and 1000° C., and pickling said steel.

12. The method of claim 1, wherein said dew point is less than 0° C.

13. The method of claim 1, wherein the content of remained C in said steel is less than 0.0010% by weight.

14. A method for manufacturing a canning steel sheet with non-aging property and superior workability, comprising the steps of:

(a) using, as a starting material, an ultra-low-carbon steel slab, said steel consisting essentially of:
(1) C: from 0.0015% to 0.0100% by weight,
(2) Si: up to 0.20% by weight,
(3) Mn: from 0.10% to 1.20% by weight,
(4) Al: from 0.02% to 0.10% by weight,
(5) P: from 0.005% to 0.040% by weight,
(6) S: up to 0.015% by weight,
(7) N: up to 0.005% by weight,
(8) at least one element selected from the group consisting of;
Nb: from 0.003% to 0.015% by weight,
Ti: from 0.003% to 0.040% by weight, and
B: from 0.0005% to 0.0020% by weight, and
(9) balance iron and unavoidable impurities;

(b) hot rolling said steel;

(c) pickling said steel;

(d) cold rolling said steel at a reduction ratio of at least 70% after said pickling step; and (e) recrystallization annealing said steel in a continuous annealing furnace in an atmosphere having a hydrogen content of from 3% to less than 10% and a dew point not lower than −20° C. at a temperature not lower than 730° C.;
whereby a content of remained C in the steel is kept less than 0.0015% by weight.

15. The method of claim 14, wherein said steel sheet has a thickness not larger than 0.3 mm after said cold rolling step.

16. The method of claim 14, further comprising secondary cold rolling said steel at a reduction ratio of from 2% to 40%.

17. The method of claim 14, wherein said niobium is present in said starting material in an amount less than 0.010% by weight.

18. The method of claim 14, wherein said titanium is present in said starting material in an amount less than 0.020 % by weight.

19. The method of claim 14, wherein said boron is present in said starting material in an amount less than 0.0010% by weight.

20. A steel sheet with non-aging property and superior workability, produced by a process comprising the steps of:

(a) using, as a starting material, an ultra-low-carbon steel slab consisting essentially of:
C: from 0.0015% to 0.0100% by weight,
Si: up to 0.20% by weight,
Mn: from 0.10% to 1.20% by weight,
Al: from 0.02% to 0.10% by weight,
P: from 0.005% to 0.040% by weight,
S : up to 0.015% by weight,
N: up to 0.005% by weight, and balance iron and unavoidable impurities;

(b) hot rolling said steel;

(c) pickling said steel;

(d) cold rolling said steel at a reduction ratio of at least 70% after said pickling step; and (e) recrystallization annealing said steel in a continuous annealing furnace in an atmosphere having a hydrogen content of from 3% to less than 10% and a dew point not lower than −20° C. at a temperature not lower than 730° C. such that the content of remained C in said steel is kept less than 0.0015% by weight.

21. A steel sheet with non-aging property and superior workability, produced by a process comprising the steps of:

(a) using, as a starting material, an ultra-low-carbon steel slab consisting essentially of:
(1) C: from 0.0015% to 0.0100% by weight,
(2) Si: up to 0.20% by weight,
(3) Mn: from 0.10% to 1.20% by weight,
(4) Al: from 0.02% to 0.10% by weight,
(5) P: from 0.005% to 0.040% by weight,
(6) S: up to 0.015% by weight,
(7) N: up to 0.005% by weight,
(8) at least one element selected from the group consisting of:
Nb: from 0.003% to 0.015% by weight,
Ti: from 0.003% to 0.040% by weight, and
B: from 0.0005% to 0.0020% by weight, and
(9) balance iron and unavoidable impurities;

(b) hot rolling said steel;

(c) pickling said steel;

(d) cold rolling said steel at a reduction ratio of at least 70% after said pickling step; and (e) recrystallization annealing said steel in a continuous annealing furnace in an atmosphere having a hydrogen content of from 3% to less than 10% and a dew point not lower than −20° C. at a temperature not lower than 730° C. such that the content of remained C in said steel is kept less than 0.0015% by weight.

* * * * *